United States Patent [19]

Willis

[11] 4,253,459

[45] Mar. 3, 1981

[54] ADDITIVE TRANSFER UNIT WITH STABILIZED SEALING MEANS

[75] Inventor: Wilburn C. Willis, Hagerstown, Ind.

[73] Assignee: Aluminum Company of America, Pittsburgh, Pa.

[21] Appl. No.: 92,064

[22] Filed: Nov. 19, 1979

Related U.S. Application Data

[63] Continuation-in-part of Ser. No. 898,157, Apr. 20, 1978, Pat. No. 4,200,100.

[51] Int. Cl.[3] ..... A61J 1/00

[52] U.S. Cl. ..... 128/272.3; 215/341; 222/567

[58] Field of Search ..... 128/216, 220, 221, 272, 128/272.1, 272.3, 347; 215/11 C, 251, 273, 277, 323, 327, 341; 222/566, 567, 574

[56] References Cited

U.S. PATENT DOCUMENTS

| | | | |
|---|---|---|---|
| Re. 29,656 | 3/1977 | Chittenden | 128/272.3 |
| 2,604,685 | 7/1952 | Harms | 128/347 |
| 2,957,501 | 10/1960 | Holmes | 141/2 |
| 3,055,367 | 9/1962 | Thorstad | 128/272 |
| 3,066,671 | 12/1962 | Cohen | 128/272 |
| 3,096,763 | 7/1963 | McConnaughey | 128/221 |
| 3,253,726 | 5/1966 | Meierhoefer | 215/11 C |
| 3,330,281 | 7/1967 | Visser | 128/272.1 |
| 3,633,580 | 1/1972 | Knox | 128/221 |
| 3,677,429 | 7/1972 | La Barge | 215/11 C |
| 3,923,059 | 12/1975 | Ogle | 128/237 |
| 3,948,266 | 4/1976 | Clark et al. | 128/272 |
| 3,987,791 | 10/1976 | Chittenden | 128/272.3 |
| 4,010,747 | 3/1977 | Clark et al. | 128/173 H |
| 4,020,839 | 3/1977 | Klapp | 128/272 |

FOREIGN PATENT DOCUMENTS

| | | | |
|---|---|---|---|
| 218169 | 1/1958 | Australia | 128/272 |
| 2245121 | 4/1973 | Fed. Rep. of Germany | 215/253 |
| 2500073 | 7/1976 | Fed. Rep. of Germany | 128/221 |

*Primary Examiner*—Robert W. Michell
*Assistant Examiner*—J. Kruter
*Attorney, Agent, or Firm*—Glenn E. Klepac

[57] ABSTRACT

An additive transfer unit for transferring a measured volume of a liquid medicament into an evacuated container. The unit comprises a liquid storage container, a rigid disc closing the mouth of the container, a rigid piercing member formed integrally with the disc and having an aperture defining a passageway from the interior to the exterior of the container, a penetrable protective tip providing a seal over a needle point on the piercing member, and a metal closure. An elastic sealing means around and contiguous the outside diameter of the disc provides, with the disc, a fluid-tight seal over the mouth of the container. The disc includes a cylindrical hub spaced radially outwardly of the piercing member and abutting against an inner portion of the sealing means to stabilize the sealing means against the metal closure. The protective tip includes a portion deflecting radially outwardly of the piercing member in response to a positive pressure differential in the interior of the container, thereby venting a portion of the container contents into a cavity between the metal closure and piercing member.

8 Claims, 6 Drawing Figures

ADDITIVE TRANSFER UNIT WITH STABILIZED SEALING MEANS

BACKGROUND OF THE INVENTION

1. Pending Related Application

This application is a continuation-in-part of copending U.S. application Ser. No. 898,157, filed Apr. 20, 1978, now U.S. Pat. No. 4,200,100.

2. Field of Invention

The present application relates to additive transfer units for storing a fixed volume of a liquid medicament and for transferring the medicament into an evacuated container.

3. Description of the Art

Bottles of parenteral solution are typically shipped to the administering institution, such as a hospital, in bulk quantity. For efficiency in production, transfer and storage of such bottles, the chemical composition of the parenteral solution is uniform, bottle to bottle, and is not subject to degradation or contamination solely on account of the age of the solution. However, the chemical composition of the solution administered to the end user, such as a patient, must be tailored according to the individual needs of the user. For example, a patient to be administered a standard intravenous solution, such as distilled water with five percent (5%) glucose, may require a quantity of vitamins, minerals, serums, such as sodium pentothal, or other drugs to be added to the parenteral solution for concurrent intravenous administration.

Medicinal additives have a tendency to degrade over a period of time and, therefore, are preferably added to the intravenous solution just prior to administration to a patient. The additives are typically packaged in five milliliter glass vials provided with a closure having a removable top portion and a hollow spike having both ends sharpened. After removal of the top portion and upon the application of force against the rubber diaphragm of the parenteral solution container, one end of the spike penetrates the container while the other end of the spike substantially simultaneously penetrates a puncturable seal provided on the vial. A vacuum maintained in the parenteral solution container pulls the additive solution therein through the hollow passageway provided in the spike.

The assembly of the closure system for the vials of the prior art is complex. Initially, all of the closure components are usually preassembled before the closure is mounted onto the container. In such preassembly, a double-edged, hollow spike, provided with an outwardly projecting rim, auxiliary core slides and the like, is inserted into a rubber stopper until the rim locks into a groove provided in the stopper. The rubber stopper is closed at the end opposite the exposed spike. A first ferrule, designed to hold the stopper onto the vial, is placed over the exposed spike and against a ledge provided on the rubber stopper. A removable overcap is placed over the exposed spike and fits tightly against the rubber stopper. A second metal ferrule, which is removable and is designed to hold the overcap onto the vial, is placed over the overcap and over the first ferrule. The preassembled closure is placed over the mouth of a vial and both ferrules are simultaneously constricted under the bead at the mouth of the vial in one rolling operation.

After the closure and vial are assembled, the assembly must be sterilized. The most common method of sterilization is by exposing the parts to a pressurized steam atmopshere at a temperature of about 250° F. (120° C.). The cavity surrounding the spike in the closure of the prior art is air tight. In order to insure that steam will be present in such cavity during heating and pressurization, it is necessary to assemble the closure parts in a wet condition. Manual wet assembly is a complicated process. The assembly of such closure systems typically adds significantly to the overall cost of the additive vial.

The vials of the prior art are typically provided with an overcap which is removable by a multiple step process. For example, it is common to have a tear-off ring provided on the top of the vial which must be pulled to sever the ring and thereby render the ring removable. Thereafter, the ring is pulled or unwrapped from the vial to free the removable overcap. The overcap may then be lifted from the vial in order to gain access to the spike.

Upon removal of the overcap from the vials of the prior art, the spike or needle is exposed. Such exposure may cause contamination from the atmosphere.

A significant technical weakness of the vials of the prior art is that during penetration of the spike of the vial into the parenteral solution container, air may be drawn into the parenteral solution. Such air is drawn by the vacuum maintained in the parenteral solution container at locations around the spike, which are characterized by uneven spike penetration.

Accordingly, an improved additive vial is desired which is characterized by relatively simple, yet efficient, construction, assembly and operation. In particular, such improved additive vial should consist of relatively few parts, will have a compact construction and should prevent leakage and minimize contamination during transfer of its contents to an evacuated parenteral solution container.

SUMMARY OF THE INVENTION

This invention may be summarized as providing an improved additive transfer unit for transferring liquid medicament into an evacuated container. Such transfer unit or vial comprises a liquid medicament storage container having a neck terminating at a generally flat-rimmed bead defining a mouth opening in the container. Closing the mouth of the container is a rigid disc, having a hollow, generally cylindrical piercing member extending axially outwardly from a central location of the disc and terminating in a needle point. An elastic sealing means is provided around and contiguous an outer portion of the container rim. The sealing means also overlies an outer peripheral portion of the exterior surface of the disc. A penetrable tip provides a seal over the needle point of the piercing member, and a removable, outwardly projecting cylindrical portion of a metal closure extends over and around the tip covering the needle point. The metal closure also includes an annular rim at least partially overlying an outer peripheral portion of the disc and the sealing means, and a depending skirt extending downwardly from the annular rim with its lower portion turned inwardly under and against the container bead to constrict the sealing means and the disc toward the rim, effectuating a seal about the rim of the container.

The disc includes a generally cylindrical hub spaced radially outwardly of the piercing member and abutting against the elastic sealing means to stabilize the sealing means against the metal closure.

In a preferred embodiment, a circular portion of the annular rim on the metal closure is indented into the sealing means toward the disc around the circumference of the annular rim, thereby maintaining a seal about the rim of the container.

In a particularly preferred embodiment, the protective tip over the needle point on the piercing member is impervious to liquids but deflects radially outwardly of the piercing member in response to a positive pressure differential of at least about 20 pounds per square inch in the interior of the container. Gas thereby passes from the interior of the container, through a passageway in the piercing member to the exterior of the container.

A principal advantage of the present invention is the provision of an additive transfer unit having a container sealed by a rigid disc and an elastic sealing means, cooperating with one another to provide a seal over the rim of the container.

A further advantage of the present invention is to provide an improved additive transfer unit wherein the interior and exterior surfaces of a needle may be steam sterilized after assembly without the necessity of adding water to the assembled components of the unit.

Among other advantages of the present invention is the provision of a new and improved compact additive transfer unit having relatively few parts so that the unit is easily assembled at low cost.

An additional advantage of the present invention is the provision of an improved additive transfer unit which maximizes sterility during transfer of a medicament into a bottle of parenteral solution by preventing air from being drawn into the bottle around the needle during transfer.

The above and other objects and advantages of the present invention will be more thoroughly understood and appreciated with reference to the following description of a preferred embodiment, read in conjunction with the drawings.

DESCRIPTION OF THE PREFERRED EMBODIMENTS

Figure 1:
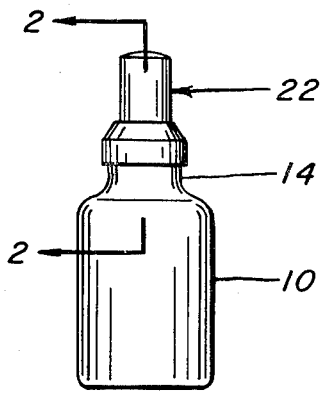
FIG. 1 is a front elevational view of an additive transfer unit of the present invention.
Figure 2:
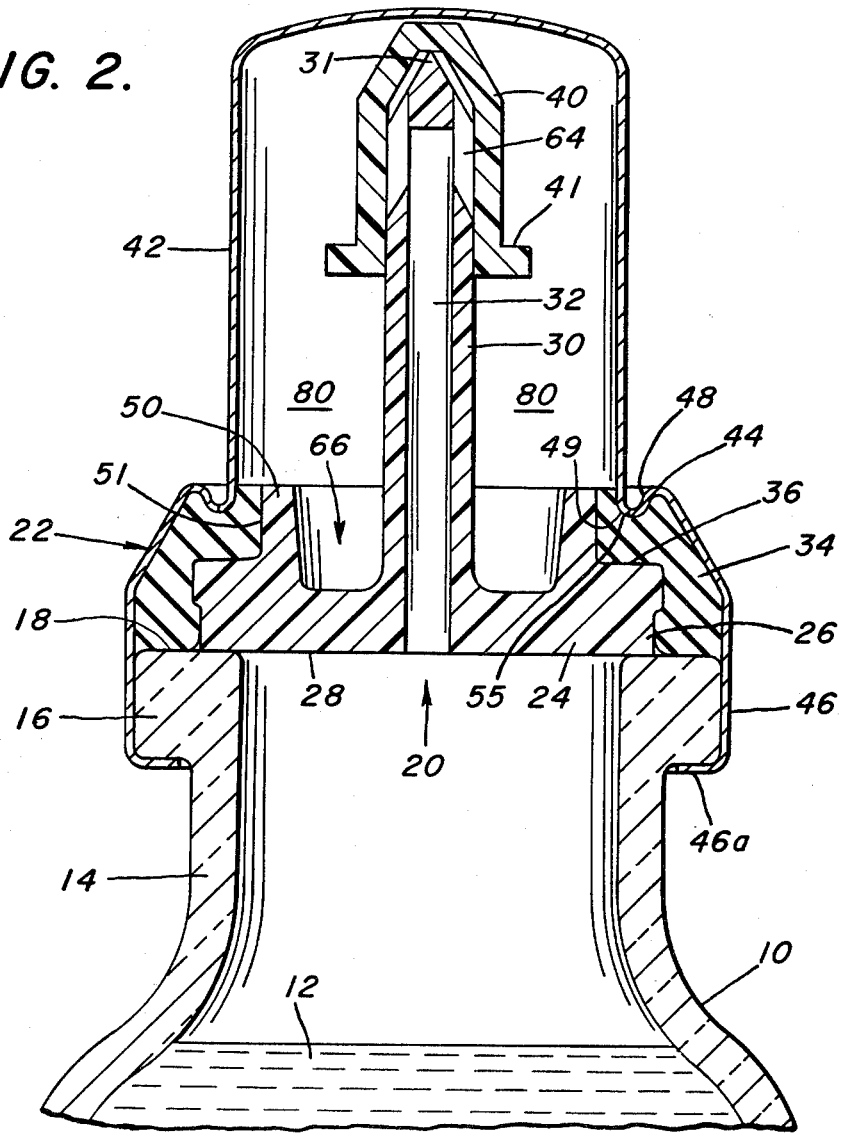
FIG. 2 is a fragmentary cross-sectional view taken along the lines 2—2 of FIG. 1.

Referring to the drawings, FIGS. 1 and 2 illustrate a preferred additive transfer unit or vial of the invention. The unit shown in FIGS. 1 and 2 includes a liquid storage container 10 for holding a medicament 12 to be transferred. The storage container 10 has a neck or neck portion 14 which terminates in a bead 16. The bead 16 is preferably provided with a generally planar rim 18, and the inside dimension of the rim defines the circumference of a mouth opening 20 in the container 10.

The liquid storage container 10 is preferably constructed of glass for sterility purposes, but it may also be constructed of plastic, metal or any other material that will support the closure system 22 described below. It will be understood that the container 10 may also be constructed of a flexible material which may aid in manual transfer of its contents by compression of its sidewalls in instances where the receiving container is not sufficiently evacuated to receive such contents without external aid. Typically, transfer units are sized to hold enough liquid medicament to efficiently transfer five milliliters. It will be understood that units of any size are comprehended by the present invention, and that the containers 10 are typically overfilled to compensate for product remaining after the desired amount has been transferred. Also, a relatively large head space of air is required to be maintained in the filled container 10 to insure that adequate air is available to force the contents of the container 10 into an evacuated parenteral solution container.

Typical additive solutions include sodium bicarbonate, antibiotics, anticoagulants and a variety of vitamins and minerals.

Referring again to FIGS. 1 and 2, a disc 24 of rigid material, such as plastic, closes the mouth 20 of the container 10. A peripheral portion 26 of the disc 24 overlies at least a portion and preferably one-third of the rim 18 of the container 10. A portion of the inner surface 28 of the disc 24 may also fit into the mouth of the container 10. In a preferred embodiment, the disc 24 is in contact with the inner circumferential portion of the rim 18 of the container 10.

A generally cylindrical, rigid, piercing member or shaft 30 extends from a central location of the disc 24 in a direction axially outwardly of the mouth 20 of the container 10, terminating in a needle point 31. The piercing member 30 must be sufficiently rigid to withstand insertion through a sealing member, such as a rubber seal closing the mouth of an intravenous bottle or the like, without bending or breaking. Plastic has been found to be the preferred material for the piercing member 30 and the disc 24. Though not required, it has also been found that the disc 24 and piercing member 30 should be cast integrally as a one-piece construction.

In the transfer unit of the present invention, an aperture 32 extends from the needle point 31 generally through a longitudinal axis of the piercing member 30 and continues through the disc 24 along such axis to define a passageway from the interior to the exterior of the container 10.

A portion of an elastic sealing member 34 is provided around and contiguous an outside diameter of the disc 24 to assist in providing an air-tight seal for the unit. A portion of the sealing member 34 preferably overlies at least an outer peripheral portion of the rim 18 of the container 10. Further, the sealing member 34 preferably overlies an outer peripheral portion 26 of the disc 24 along an exterior surface 36 of the disc 24. It should be understood that the disc 24 has an exterior surface 36 and an interior surface 28 with respect to the container 10.

The needle point 31 of the piercing member 30 is covered with a protective tip 40. The tip 40 is preferably elastic and, in the embodiment illustrated in FIG. 2, is fit tightly over all of the slots 64 provided in the needle point 31 in order to isolate the passageway 32 therethrough and to provide an hermetic seal for the container 10 under normal conditions. The protective tip 40 must be readily penetrable by the needle point 31.

In a preferred embodiment, as illustrated in FIG. 2, the protective tip 40 should be so flexible that a bottom portion 41 of the tip 40 would deflect in a direction radially outwardly of the slots 64 in the needle point 31 in response to a positive pressure differential of approximately 20 to 30 pounds per square inch (137.9 to 206.8 kilopascals) inside the container 10. This feature permits dry assembly of the transfer unit, yet assures steam sterilization of a cavity 80 surrounding the piercing member 30. By heating the assembled unit, a portion of the solution vaporizes and creates a pressure inside the container 10 greater than the pressure in the cavity 80. When such pressure differential reaches at least about 20 pounds per square inch, the pressurized vapor in the container 10 vents into the cavity 80 through a small passageway 43, shown in FIG. 3, created under the protective tip 40. During such venting, a small quantity of vapor will pass into the cavity adequate to effectuate steam sterilization of the cavity 80. Such embodiment eliminates the necessity of wet assembly of the closure parts.

Figure 5:
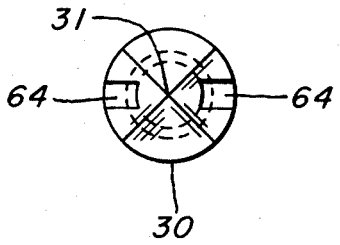
FIG. 5 is a top elevational view of the needle shown in FIG. 3.
Figure 3:
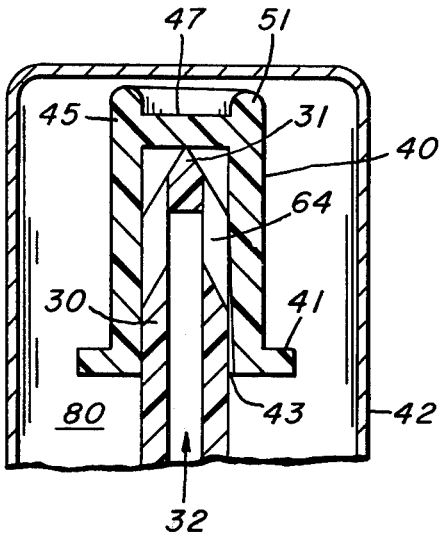
FIG. 3 is an enlarged, fragmentary cross-sectional view of an upper portion of a second embodiment of a transfer unit of the invention.
Figure 4:
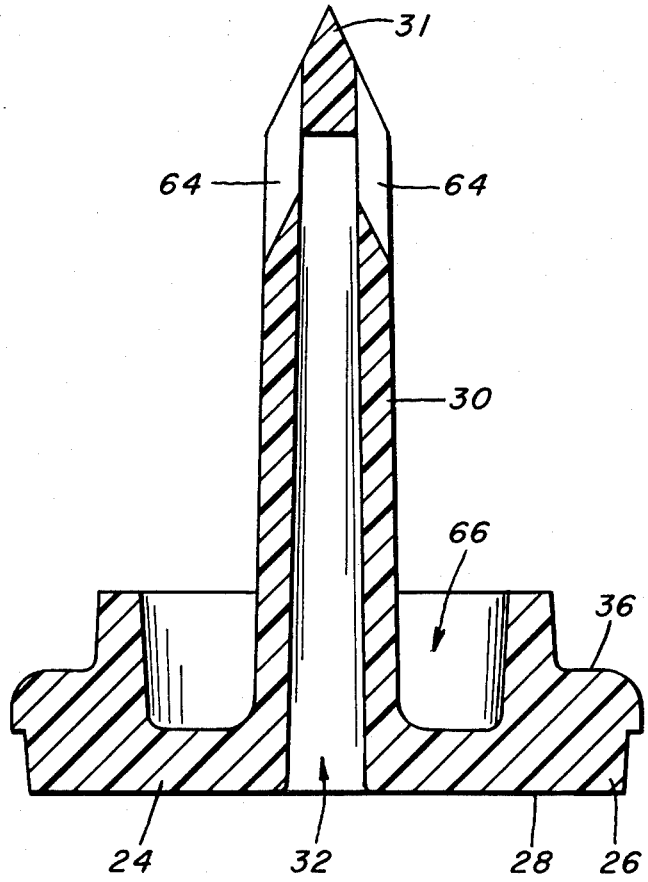
FIG. 4 is a cross-sectional view of a needle of the additive transfer unit shown in FIG. 2.

A preferred construction for the protective tip 40 is illustrated in FIG. 3. Preferably the upper portion 45 of the tip 40 has a generally planar top surface 47 and is preferably provided with an upwardly projecting peripheral ring-shaped projection 51. As explained below, such ring-type construction insures that a seal is maintained around the needle 30 as the container contents are being transferred into a parenteral solution container. The needle point 31 of the piercing member 30 may have any construction. A preferred needle construction is shown in FIGS. 4 and 5. The preferred needle point 31 is generally pyramid shaped having four equally spaced sharp corners. It will be understood that three, five or six corners may also be provided by similar or equivalent design. In the pyramid-shaped needle 30 shown in FIGS. 4 and 5, the point 31 is located centrally of the shaft 30. The passageway 32, therefore, extends through a longitudinal axis of the piercing member 30 to a location near the point 31 and a plurality of slots 64, preferably two oppositely disposed slots 64, are provided in the sharpened walls defining point 31 to provide gaseous communication with the exterior of the container 10.

The tip 40 covering the needle point 31 should extend completely over the slots 64, as illustrated in FIGS. 2 and 3. Upon penetration of the needle 30 into the elastic tip 40 and into a penetrable seal on a parenteral solution bottle, the four sharp corners create a high tear stress along their respective edges causing the penetrable material to tear substantially uniformly. Thus, rather than having one large, non-uniform tear, four small, controlled tears result in forming a substantially even X-shaped in the target area of the penetrable material.

A metal closure 22, preferably constructed of aluminum, is provided over the disc 24, the piercing member 30 and the sealing member 34 to hold the parts in place and to protect the piercing member 30. The closure 22 has an outwardly projecting cylindrical portion 42 extending over and around the piercing member 30. This outwardly projecting cylindrical portion 42 is manually removable and also serves as a tamper-proof seal. At the base of the cylindrical portion 42 is an annular rim 44 overlying an outer peripheral portion of the disc 24 and the sealing member 34. A depending skirt 46 extends downwardly from the annular rim 44 of the closure. A lower portion **46*a* of the skirt 46 is turned inwardly under and against the container bead 16 around the periphery of the container mouth 20. Such inward deformation of the closure skirt 46 constricts the elastic sealing member 34 and the disc 24 toward the rim 18 of the container 10. Inward deformation of the closure skirt 46 under the bead 16 in combination with a seal 49 at the base of the top portion 42 effectuates an hermetic seal about the rim 18 of the container 10**.

Referring now to FIGS. 2 and 4, the disc 24 includes a generally cylindrical hub 50 extending axially outwardly from the upper portion thereof. The hub is spaced radially outwardly a short distance from the piercing member 30 and includes a radially outwardly facing outer surface portion 51 abutting against an inner peripheral portion of the elastic sealing means 34. Such abutment between the hub 50 and sealing means 54 stabilizes the sealing means 34 and cylindrical portion 42 in sealing relationship with one another.

In a preferred embodiment, a circular portion 48 of the annular rim 44, which overlies the outer peripheral portion 26 of the disc 24 and the sealing member 34, is indented toward the sealing member 34 and disc 24, thereby providing a seal 49 beginning at the indentation 48 and extending outwardly and downwardly along the annular rim 44 and closure skirt 46 to the rim 18 of the container. Such seal is maintained around the circumference of the rim 44. This indenting action also assists in constricting the elastic sealing member 34 and the disc 24 toward the rim 18 of the container 10, and thereby assists in maintaining the hermetic seal. Tests have shown that the seal about the rim 18 is maintained without leakage at pressures in excess of 60 pounds per square inch (413.7 kilopascals). Such excessive pressures should never be experienced in routine practice. One mode for rendering the outwardly projecting cylindrical portion 42 removable is to provide a circular score or scoreline 55 around the circumference of the rim 44 of the closure 22. Such score 55 is preferably provided through at least 50% of the metal thickness to permit manual removal of the cylindrical portion 42. Even though the score 55 penetrates through the metal of the indentation 48, an air-tight seal is still maintained between the cylindrical portion 42 and sealing means 34. The hub 50 stabilizes the sealing means 34 against the cylindrical portion 42 after the indentation 48 and score 55 are formed, thereby preventing passage of air until the cylindrical portion 42 is removed.

In a preferred embodiment, the exterior surface 36 of the disc 24 is provided with a recess 66 about the piercing member 30. As shown in FIGS. 2 and 4, the recess 66 is preferably ring shaped and is centrally provided substantially concentric with the piercing member 30. The recess 66 provides room within which the elastic tip 40 may be compressed as the piercing member 30 is inserted into the stopper of an intravenous container or the like. Providing such recess 66 insures that the piercing member may be inserted into a bottle of parenteral solution at a maximum depth with minimum interference from displacement of the elastic tip 40 as it slides downwardly of the piercing shaft 30 during insertion.

Additive vials of the prior art typically had to be manually assembled wet under clean conditions in a sterile environment. Moisture trapped between the parts would vaporize and thereby sterilize the vial cavities when an entire package was pasteurized. Such expensive steps are eliminated by the present invention.

The cavity 80 between the outside of the needle and the inside of the cylindrical portion 42 of the closure 22 may be sterilized by steam vapor. In utilizing the transfer unit of the present invention, such steam vapor is able to vent from under the elastic tip 40. Such venting is possible because the vapor pressure inside the container 10 at temperatures experienced during the retort cycle is greater than pressure in the cavity 80 outside the piercing member 30. Such simplification in sterilizing methods has a unique, economical advantage over wet assembly used in vials of the prior art.

In operation of the transfer unit of the present invention, the outwardly projecting cylindrical portion 42 is manually removed. Removal of the cylindrical portion 42 may be readily accomplished by pushing laterally against the cylindrical portion 42 with the thumb or forefinger or both, causing the closure to fracture adjacent the annular rim 44. A subsequent pulling or twisting action against the cylindrical portion 42 completely separates that portion 42 from the unit.

After the cylindrical portion 42 has been removed, the elastic tip 40 protects from atmospheric contamination the contents of the unit. The elastic tip 40 provides protection by covering the needle point 31 and thereby seals off the passageway through the piercing member 30.

Figure 6:
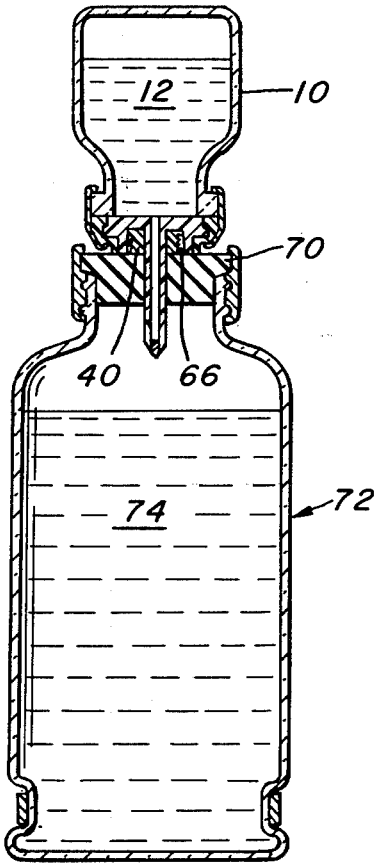
FIG. 6 is a cross-sectional view of an additive transfer unit of the present invention showing a needle inserted through a stopper of a bottle of parenteral solution.

To transfer a liquid medicament 12 from the transfer unit to a bottle of intravenous solution or the like, the unit is inverted and the covered point 31 of the piercing member 30 is directed against a penetrable portion of the receiving container. As shown in FIG. 6, the unit is pushed against a penetrable rubber stopper 70 provided over the mouth of the bottle 72 of parenteral solution 74. As the inverted vial is moved toward the stopper 70, the outer peripheral ring 51 on the upper portion 45 of the elastic sealing member 40 contacts the outside surface of the rubber stopper 70. As the unit is moved further, the point 31 of the piercing member 30 penetrates the elastic sealing member 40. The ring 51 seals against the receiving container and assists in preventing air from entering the receiving container from around the needle 31 during insertion. The unit is pushed into the stopper 70 until the annular rim 44 of the closure 22 approaches the exterior surface of the stopper 70 insuring that the passageway extends into the interior of the bottle 72 of solution 74. During insertion of the piercing member 30 through the stopper 70, the elastic sealing member 40 is displaced along the shaft 30 and eventually is compressed into the recess 66 provided in the disc 24 so as not to interfere with penetration of the needle point 31.

Typically, a vacuum exists in the bottle 72 sufficient to create a pressure differential between the containers. Such pressure differential causes the more positive pressure gas in the vial to respond in an attempt to overcome the vacuum and thereby force the liquid medicament 12 in the vial through the passageway 32. As mentioned above, however, flexible sidewalls may be provided that are manually compressible to assist in such transfer.

The stopper 70 is typically constructed of suitable resilient material that automatically reseals the interior of the bottle 72 from the atmosphere as the piercing member 30 is retracted therefrom. After the additive transfer unit has been used, it is typically discarded.

While the foregoing description of my invention has been made with reference to several preferred embodiments described above for purpose of illustration, persons skilled in the art will understand that numerous changes and modifications may be made therein without departing from the spirit and scope of the invention as defined by the following claims.

What is claimed is:

1. An additive transfer unit for transferring a liquid medicament into a container comprising:

a liquid storage container for holding the medicament to be transferred, said container having a neck portion terminating at a bead, said bead having a rim, with the inside dimension of the rim defining the circumference of a mouth of the container;

a disc of rigid material closing the mouth of the container, with a lower portion of said disc overlying at least a portion of the rim of the container;

a rigid piercing member extending from a central location of the disc in a direction axially outwardly of the mouth of the container, terminating in a needle point, said disc and said piercing member comprising an integral, one-piece structure;

an aperture extending from the needle point through a longitudinal axis of the piercing member and continuing through the disc along such axis to define a passageway from the interior of the container to the exterior of the container;

a protective tip providing a seal over the needle point of the piercing member;

elastic sealing means around and contiguous the outside diameter of the disc overlying at least a portion of the rim of the container, and overlying an outer peripheral portion of the disc, said sealing means and said disc providing, in combination, a fluid-tight seal over the mouth of the container;

and wherein said disc further comprises a hub extending axially outwardly of the upper portion of the disc, said hub being spaced radially outwardly of the piercing member and including a radially outwardly facing outer surface portion abutting against an inner peripheral portion of the elastic sealing means.

2. An additive transfer unit as set forth in claim 1 wherein the protective tip is penetrable by the needle point.

3. An additive transfer unit as set forth in claim 1 wherein the protective tip is impervious to liquids and wherein said protective tip includes a bottom portion deflecting radially outwardly of the piercing member in response to a positive pressure differential in the interior of the container, whereby gas passes from the interior of the container to the exterior of the container in response to a positive pressure differential in the interior of the container.

4. An additive transfer unit as set forth in claim 3 wherein the positive pressure differential required to deflect said bottom portion is at least about 20 pounds per square inch.

5. An additive transfer unit as set forth in claim 1 and further comprising a metal closure having a removable, outwardly projecting portion extending over and around the piercing member and the protective tip, and annular rim at least partially overlying an outer peripheral portion of the sealing means, and a depending skirt extending downwardly from the annular rim.

6. An additive transfer unit as set forth in claim 5 wherein a bottom portion of the protective tip deflects radially outwardly of the piercing member when the pressure in the vial exceeds by about 20 pounds per square inch the pressure in a cavity between the piercing member and the closure, thereby to vent a portion of the pressurized contents of the vial into the cavity.

7. An additive transfer unit as set forth in claim 5 wherein a circular portion of the annular rim overlying the sealing means is indented into the sealing means toward the disc around the circumference of the annular rim, constricting the sealing means and the disc toward the rim of the container to maintain a seal about the rim of the container.

8. An additive transfer unit as set forth in claim 7 wherein the circular portion of the annular rim indented into the sealing means is provided with a circular score line around the circumference of the closure at a sufficient depth to permit manual removal of at least an outwardly projecting cylindrical portion of the closure, and wherein said hub stabilizes the sealing means in sealing relationship with the cylindrical portion.

* * * * *